US008602579B2

(12) United States Patent
Van de Ven et al.

(10) Patent No.: US 8,602,579 B2
(45) Date of Patent: Dec. 10, 2013

(54) LIGHTING DEVICES INCLUDING THERMALLY CONDUCTIVE HOUSINGS AND RELATED STRUCTURES

(75) Inventors: Antony Paul Van de Ven, Hong Kong (HK); Wai Kwan Chan, Hong Kong (HK); Chin Wah Ho, Hong Kong (HK)

(73) Assignee: Cree, Inc., Durham, NC (US)

( * ) Notice: Subject to any disclaimer, the term of this patent is extended or adjusted under 35 U.S.C. 154(b) by 240 days.

(21) Appl. No.: 12/795,290

(22) Filed: Jun. 7, 2010

(65) Prior Publication Data

US 2011/0074289 A1 Mar. 31, 2011

Related U.S. Application Data

(63) Continuation-in-part of application No. 12/621,970, filed on Nov. 19, 2009, which is a continuation-in-part of application No. 12/566,857, filed on Sep. 25, 2009, said application No. 12/795,290 is a continuation-in-part of application No. 12/566,861, filed on Sep. 25, 2009, and a continuation-in-part of application No. 29/344,218, filed on Sep. 25, 2009, now Pat. No. Des. 633,099.

(51) Int. Cl.
*H01K 1/62* (2006.01)

(52) U.S. Cl.
USPC ..... 362/96; 362/249.02; 362/294; 362/646; 362/650

(58) Field of Classification Search
USPC ..... 362/96, 640.646, 650, 294, 373
See application file for complete search history.

(56) References Cited

U.S. PATENT DOCUMENTS

| | | | |
|---|---|---|---|
| 446,142 | A | 2/1891 | Martin |
| D188,916 | S | 9/1960 | Harling |
| D207,867 | S | 6/1967 | Pettengill |
| 3,560,728 | A | 2/1971 | Atkin |
| 3,755,697 | A | 8/1973 | Miller |
| 3,787,752 | A | 1/1974 | Delay |
| 4,090,189 | A | 5/1978 | Fisler |
| 4,717,868 | A | 1/1988 | Peterson |
| 4,798,983 | A | 1/1989 | Mori |

(Continued)

FOREIGN PATENT DOCUMENTS

| | | | |
|---|---|---|---|
| EP | 1 881 259 | A1 | 1/2008 |
| WO | WO 2008/007388 | A1 | 1/2006 |

(Continued)

OTHER PUBLICATIONS

U.S. Appl. No. 29/353,900, filed Jan. 15, 2010, Van de Ven.

(Continued)

*Primary Examiner* — Anabel Ton
(74) *Attorney, Agent, or Firm* — Myers Bigel Sibley & Sajovec, P.A.

(57) ABSTRACT

A lighting device may include a light emitting device and a sidewall extending away from the light emitting device. In addition, a thermally conductive housing may be spaced apart from the sidewall, and a cavity may be defined between the sidewall and the thermally conductive housing. In addition, a lens may be spaced apart from the light emitting device with the sidewall extending away from the light emitting device to the lens to define a mixing chamber adjacent the light emitting device. Moreover, the thermally conductive housing may be outside the mixing chamber, and the sidewall may be reflective.

39 Claims, 8 Drawing Sheets

(56) References Cited

U.S. PATENT DOCUMENTS 4,839,535 A 6/1989 Miller
4,841,422 A 6/1989 Groh
4,918,487 A 4/1990 Coulter, Jr.
5,138,541 A 8/1992 Kano
5,151,679 A 9/1992 Dimmick
5,175,528 A 12/1992 Choi et al.
5,345,167 A 9/1994 Hasegawa et al.
5,397,938 A 3/1995 Wilhelm et al.
5,528,467 A 6/1996 Jiang
5,631,190 A 5/1997 Negley
5,661,645 A 8/1997 Hochstein
D384,430 S 9/1997 Lecluze
5,736,881 A 4/1998 Ortiz
5,803,579 A 9/1998 Turnbull et al.
D400,280 S 10/1998 Leen
5,844,377 A 12/1998 Anderson et al.
5,912,477 A 6/1999 Negley
5,912,568 A 6/1999 Kiley
D418,620 S 1/2000 Grossman
D425,024 S 5/2000 Klaus et al.
6,079,852 A 6/2000 Kamaya et al.
6,150,771 A 11/2000 Perry
6,161,910 A 12/2000 Reisenauer et al.
D437,439 S 2/2001 Tang
6,222,172 B1 4/2001 Fossum et al.
6,264,354 B1 7/2001 Motilal
6,285,139 B1 9/2001 Ghanem
6,329,760 B1 12/2001 Bebenroth
6,340,868 B1 1/2002 Lys et al.
6,350,041 B1 2/2002 Tarsa et al.
6,362,578 B1 3/2002 Swanson et al.
6,388,393 B1 5/2002 Illingworth
6,400,101 B1 6/2002 Biebl et al.
6,528,954 B1 3/2003 Lys et al.
6,577,072 B2 6/2003 Saito et al.
6,586,890 B2 7/2003 Min et al.
6,600,175 B1 7/2003 Baretz et al.
6,614,358 B1 9/2003 Hutchison et al.
6,636,003 B2 10/2003 Rahm et al.
6,724,376 B2 4/2004 Sakura et al.
D490,181 S 5/2004 Redfern
6,747,420 B2 6/2004 Barth et al.
6,755,550 B1 6/2004 Lackey
6,791,840 B2 9/2004 Chun
6,808,287 B2 10/2004 Lebens et al.
6,836,081 B2 12/2004 Swanson et al.
6,841,947 B2 1/2005 Berg-johansen
6,873,203 B1 3/2005 Latham, II et al.
6,987,787 B1 1/2006 Mick
6,995,518 B2 2/2006 Havlik et al.
7,014,341 B2 3/2006 King et al.
7,038,399 B2 5/2006 Lys et al.
7,071,762 B2 7/2006 Xu et al.
7,081,722 B1 7/2006 Huynh et al.
7,088,059 B2 8/2006 McKinney et al.
7,108,238 B2 9/2006 Gauci
7,119,498 B2 10/2006 Baldwin et al.
7,144,140 B2 * 12/2006 Sun et al. ..... 362/373
7,180,487 B2 2/2007 Kamikawa et al.
7,202,608 B2 4/2007 Robinson et al.
7,213,940 B1 5/2007 Van de Ven et al.
D544,979 S 6/2007 Hartmann et al.
7,226,189 B2 * 6/2007 Lee et al. ..... 362/294
D557,853 S 12/2007 Sandell
D558,374 S 12/2007 Sandell
7,408,308 B2 8/2008 Sawada et al.
D576,964 S 9/2008 Shaner
7,458,706 B1 12/2008 Liu et al.
7,513,639 B2 4/2009 Wang
7,566,154 B2 7/2009 Gloisten et al.
7,614,767 B2 11/2009 Zulim et al.
7,614,769 B2 11/2009 Sell
7,628,513 B2 * 12/2009 Chiu ..... 362/311.02
7,637,635 B2 12/2009 Xiao et al.
D610,291 S 2/2010 Yoshinobu et al.
7,677,767 B2 * 3/2010 Chyn ..... 362/294
D618,376 S 6/2010 Redfern et al.
7,758,223 B2 * 7/2010 Osawa et al. ..... 362/547
7,780,318 B2 8/2010 Xiao et al.
D625,038 S 10/2010 Yoo
D627,502 S 11/2010 Zheng et al.
D627,911 S 11/2010 Mo et al.
7,824,075 B2 * 11/2010 Maxik ..... 362/294
7,862,201 B2 * 1/2011 Ge et al. ..... 362/217.09
7,862,214 B2 1/2011 Trott et al.
7,871,184 B2 * 1/2011 Peng ..... 362/294
D633,099 S 2/2011 Van De Ven et al.
7,914,902 B2 3/2011 Kao et al.
D636,921 S 4/2011 Van De Ven et al.
D636,922 S 4/2011 Yoshida et al.
D638,160 S 5/2011 Van De Ven et al.
7,994,725 B2 8/2011 Bouchard
8,008,845 B2 8/2011 Van de Ven
D646,011 S 9/2011 Rashida
8,157,422 B2 * 4/2012 Paik et al. ..... 362/294
8,235,555 B2 8/2012 Thomas et al.
8,242,704 B2 8/2012 Lethellier
8,246,202 B2 8/2012 Mart et al.
2002/0097095 A1 7/2002 Jeon et al.
2005/0007164 A1 1/2005 Callahan
2005/0111222 A1 5/2005 Olsson et al.
2005/0128752 A1 6/2005 Ewington et al.
2005/0169015 A1 8/2005 Luk et al.
2005/0174065 A1 8/2005 Janning
2005/0242742 A1 11/2005 Cheang et al.
2005/0276053 A1 12/2005 Nortrup et al.
2006/0244396 A1 11/2006 Bucur
2006/0255753 A1 11/2006 Sawada et al.
2007/0108843 A1 5/2007 Preston et al.
2007/0137074 A1 6/2007 Van de Ven
2007/0139920 A1 6/2007 Van de Ven
2007/0139923 A1 6/2007 Negley
2007/0170447 A1 7/2007 Negley
2007/0171145 A1 7/2007 Coleman
2007/0215027 A1 9/2007 MacDonald et al.
2007/0236911 A1 10/2007 Negley
2007/0236920 A1 10/2007 Snyder
2007/0247414 A1 10/2007 Roberts
2007/0263393 A1 11/2007 Van de Ven
2007/0267983 A1 11/2007 Van de Ven
2007/0274063 A1 11/2007 Negley
2007/0274080 A1 11/2007 Negley
2007/0278503 A1 12/2007 Van de Ven
2007/0278934 A1 12/2007 Van de Ven
2007/0278974 A1 12/2007 Van de Ven
2007/0279440 A1 12/2007 Negley
2007/0279903 A1 12/2007 Negley
2007/0280624 A1 12/2007 Negley
2008/0030993 A1 2/2008 Narendran et al.
2008/0054281 A1 3/2008 Narendran et al.
2008/0084685 A1 4/2008 Van de Ven
2008/0084700 A1 4/2008 Van de Ven
2008/0084701 A1 4/2008 Van de Ven
2008/0088248 A1 4/2008 Myers
2008/0089053 A1 4/2008 Negley
2008/0089071 A1 4/2008 Wang
2008/0094000 A1 4/2008 Yamamoto et al.
2008/0094829 A1 4/2008 Narendran et al.
2008/0105887 A1 5/2008 Narendran et al.
2008/0106895 A1 5/2008 Van de Ven
2008/0106907 A1 5/2008 Trott
2008/0112168 A1 5/2008 Pickard
2008/0112170 A1 5/2008 Trott
2008/0112183 A1 5/2008 Negley
2008/0117500 A1 5/2008 Narendran et al.
2008/0128718 A1 6/2008 Sumitani
2008/0130285 A1 6/2008 Negley
2008/0136313 A1 6/2008 Van de Ven
2008/0137347 A1 6/2008 Trott
2008/0186704 A1 8/2008 Chou et al.
2008/0211415 A1 9/2008 Altamura
2008/0259589 A1 10/2008 Van de Ven
2008/0278928 A1 11/2008 Van de Ven
2008/0278940 A1 11/2008 Van de Ven

(56) References Cited

U.S. PATENT DOCUMENTS

| | | | |
|---|---|---|---|
| 2008/0278950 | A1 | 11/2008 | Pickard |
| 2008/0278952 | A1 | 11/2008 | Trott |
| 2008/0278957 | A1 | 11/2008 | Pickard |
| 2008/0304260 | A1 | 12/2008 | Van de Ven |
| 2008/0304261 | A1 | 12/2008 | Van de Ven |
| 2008/0304269 | A1 | 12/2008 | Pickard |
| 2008/0309255 | A1 | 12/2008 | Myers |
| 2009/0034283 | A1 | 2/2009 | Albright et al. |
| 2009/0046464 | A1 | 2/2009 | Liu et al. |
| 2009/0059582 | A1 | 3/2009 | Kulkarni |
| 2009/0086474 | A1 | 4/2009 | Chou |
| 2009/0101930 | A1 | 4/2009 | Li |
| 2009/0108269 | A1 | 4/2009 | Negley |
| 2009/0147517 | A1 | 6/2009 | Li et al. |
| 2009/0160363 | A1 | 6/2009 | Negley |
| 2009/0161356 | A1 | 6/2009 | Negley |
| 2009/0184616 | A1 | 7/2009 | Van de Ven |
| 2009/0184662 | A1 | 7/2009 | Given |
| 2009/0184666 | A1 | 7/2009 | Myers |
| 2009/0296384 | A1 | 12/2009 | Van de Ven |
| 2010/0027258 | A1 | 2/2010 | Maxik et al. |
| 2010/0060130 | A1 | 3/2010 | Li |
| 2010/0060175 | A1 | 3/2010 | Lethellier |
| 2010/0067227 | A1 | 3/2010 | Budike |
| 2010/0079059 | A1 | 4/2010 | Roberts et al. |
| 2010/0079262 | A1 | 4/2010 | Van Laanen |
| 2010/0102199 | A1 | 4/2010 | Negley |
| 2010/0102697 | A1 | 4/2010 | Van de Ven |
| 2010/0103678 | A1 | 4/2010 | Van de Ven |
| 2010/0109570 | A1 | 5/2010 | Weaver |
| 2010/0135016 | A1 | 6/2010 | Ishibashi |
| 2010/0177509 | A1 | 7/2010 | Pickard |
| 2010/0225220 | A1 | 9/2010 | Tanaka et al. |
| 2010/0246177 | A1 | 9/2010 | Van de Ven |
| 2010/0246197 | A1 | 9/2010 | Takahashi et al. |
| 2010/0308739 | A1 | 12/2010 | Shteynberg et al. |
| 2010/0327746 | A1 | 12/2010 | Hisayasu |
| 2011/0031894 | A1 | 2/2011 | Van de Ven |
| 2011/0068696 | A1 | 3/2011 | Van de Ven |
| 2011/0068702 | A1 | 3/2011 | Van de Ven |
| 2011/0074265 | A1 | 3/2011 | Van de Ven |
| 2011/0074289 | A1 | 3/2011 | Van de Ven |
| 2011/0075411 | A1 | 3/2011 | Van De Ven et al. |
| 2011/0075414 | A1 | 3/2011 | Van De Ven et al. |
| 2011/0075422 | A1 | 3/2011 | Van de Ven et al. |
| 2011/0075423 | A1 | 3/2011 | Van de Ven |
| 2011/0169417 | A1 | 7/2011 | Hum et al. |
| 2011/0180818 | A1 | 7/2011 | Lerman et al. |
| 2011/0181194 | A1 | 7/2011 | Hum et al. |
| 2011/0198984 | A1 | 8/2011 | Van de Ven |
| 2011/0211351 | A1 | 9/2011 | Van de Ven |

FOREIGN PATENT DOCUMENTS

| | | | |
|---|---|---|---|
| WO | WO 2008/036873 | | 3/2008 |
| WO | WO 2008/051957 | | 5/2008 |
| WO | WO 2008/051957 | A2 | 5/2008 |
| WO | WO 2008/061082 | | 5/2008 |
| WO | WO 2008/129504 | A1 | 10/2008 |

OTHER PUBLICATIONS

U.S. Appl. No. 29/344,219, filed Sep. 25, 2009, Van de Ven.
U.S. Appl. No. 29/344,218, filed Sep. 25, 2009, Van de Ven.
U.S. Appl. No. 12/621,970, filed Nov. 19, 2009, Van de Ven et al.
U.S. Appl. No. 12/566,857, filed Sep. 25, 2009, Van de Ven et al.
Global Patent Literature Text Search Corresponding to PCT Application No. PCT/US2011/38995; Date of Search: Sep. 8, 2011; 7 pages.
International Search Report and The Written Opinion of The International Searching Authority Corresponding to International Application No. PCT/US2011/038995; Date of Mailing: Sep. 16, 2011; 9 pages.
International Search Report Corresponding to International Application No. PCT/US2010/049581; Date of Mailing: Nov. 23, 2010; 3 pages.
International Search Report Corresponding to International Application No. PCT/US2011/033736; Date of Mailing: Jul. 7, 2011; 10 Pages.
International Preliminary Report on Patentability Corresponding to PCT/US2011/033736; Date of Mailing: Nov. 22, 2012; 8 Pages.
"*ASSIST Recommends . . . LED Life for General Lighting: Definition of Life*", vol. 1. Issue 1, Feb. 2005.
"*Bright Tomorrow Lighting Competition* (*L Prize*™)", May 20, 2008 Document No. 08NT006643.
"*Energy Star® Program Requirements for Solid State Lighting Luminaires, Eligibility Criteria—Version 1.1*", Final: Dec. 19, 2008.
Application Note: CLD-APO6.006, entitled *Cree® XLamp® XR Family & 4550 LED Reliability*, published at cree.com/xlamp, Sep. 2008.
DuPont "*DuPont™ Diffuse Light Reflector*", Publication K-20044, May 2008, 2 pages.
Furukawa Electric Co., Ltd., Data Sheet, "*New Material for illuminated Panels Microcellular Reflective Sheet MCPET*", updated Apr. 8, 2008, 2 pages.
Illuminating Engineering Society Standard LM-80-08, entitled "*IES Approved Method for Measuring Lumen Maintenance of LED Light Sources*", Sep. 22, 2008, ISBN No. 978-0-87995-227-3.
LEDs Magazine, Press Release May 23, 2007, "*Furukawa America Debuts MCPET Reflective Sheets to Improve Clarity, Efficiency of Lighting Fixtures*", downloaded Jun. 25, 2009 from http://www.ledsmagazine.com/press/15145, 2 pages.
Notification of Transmittal of the International Search Report and the Written Opinion of the International Searching Authority, or the Declaration; International Search Report; and Written Opinion of the International Searching Authority, PCT Application No. PCT/US2010/037608, Jul. 30, 2010.
Philips Lumileds, Technology White Paper: "Understanding power LED lifetime analysis", downloaded from http://www.philipslumileds.com/pdfs.WP12.pdf. Document No. WP12, Last Modified May 22, 2007.
MCPET—Microcellular Reflective Sheet Properties, http://www.trocellen.com, downloaded Jun. 25, 2009, 2 pages.
International Preliminary Report on Patentability Corresponding to International Application No. PCT/US2011/038995; Date of Mailing: Dec. 20, 2012; 7 Pages.
Japanese Office Action Corresponding to Japanese Patent Application No. 2012-530920; Date Mailed: Jun. 12, 2013; Foreign Text, 1 Page. English Translation Thereof, 2 Pages.

* cited by examiner

LIGHTING DEVICES INCLUDING THERMALLY CONDUCTIVE HOUSINGS AND RELATED STRUCTURES

RELATED APPLICATIONS

This application is a continuation-in-part (CIP) of U.S. patent application Ser. No. 12/621,970, filed Nov. 19, 2009, which is a continuation-in-part (CIP) of U.S. patent application Ser. No. 12/566,857, filed Sep. 25, 2009. This application is also a continuation-in-part (CIP) of U.S. application Ser. No. 12/566,861 filed Sep. 25, 2009, and of U.S. Application No. 29/344,218, filed Sep. 25, 2009 now U.S. Pat. No. D. 633,099. The disclosures of all of the above referenced applications are hereby incorporated herein in their entireties by reference.

BACKGROUND

There is an ongoing effort to develop systems that are more energy efficient. Because a large portion (some estimates are as high as twenty five percent) of electricity generated in the United States is used for lighting, there are ongoing efforts to provide lighting that is more energy efficient. Solid state light emitting devices (e.g., light emitting diodes) are receiving attention because light can be generated more efficiently using solid state light emitting devices than using conventional incandescent or fluorescent light bulbs. Moreover, lifetimes of solid state light emitting devices may be significantly longer than lifetimes of conventional incandescent or fluorescent light bulb.

Conventional light bulbs, however, generally operate using 120 volt AC electrical power provided through an Edison fixture configured to receive an Edison screw fitting provided on conventional light bulbs. Existing buildings are thus generally provided with Edison fixtures in enclosures configured to receive conventional light bulbs, while solid state lighting devices may require DC power. Moreover, performances and lifetimes of solid state lighting devices may be negatively impacted if proper cooling is not provided, and space provided by conventional fixtures (e.g., lighting cans) for conventional light bulbs may not easily accommodate cooling structures typically provided for solid state lighting devices.

Accordingly, there continues to exist a need in the art for more efficient lighting devices that are compatible with existing AC lighting fixtures.

SUMMARY

According to some embodiments of the present invention, a lighting device may include a light emitting device and a sidewall extending away from the light emitting device. A thermally conductive housing may be spaced apart from the sidewall. Accordingly, a cavity may be defined between the sidewall and the thermally conductive housing.

The thermally conductive housing may include openings therethrough providing fluid communication between the cavity inside the thermally conductive housing and space outside the thermally conductive housing. In addition, a heat dissipating element may be provided in the cavity between the sidewall and the thermally conductive housing, and portions of the heat dissipating element may be spaced apart from both the sidewall and the thermally conductive housing. The heat dissipating element may be configured to allow fluid communication between portions of the cavity between the heat dissipating element and the sidewall and portions of the cavity between the heat dissipating element and the thermally conductive housing. Moreover, the thermally conductive housing and the heat dissipating element may both be thermally coupled to the light emitting device.

A lens may be spaced apart from the light emitting device, and the sidewall may extend away from the light emitting device to the lens to define a mixing chamber adjacent the light emitting device. A cross section of the outside surface of the thermally conductive housing may be substantially symmetric with respect to a central axis of the lighting device, and a first width nearest the light emitting device may be less than a second width more distant from the light emitting device. The outside surface of the thermally conductive housing may define a substantially frustoconical shape, and/or the outside surface of the thermally conductive housing may be free of fins. Moreover, a greatest width of the outside surface of the thermally conductive housing may be in the range of about 90 mm to about 110 mm, and/or an Edison screw fitting may be electrically coupled to the light emitting device, with the Edison screw fitting being aligned with the central axis of the lighting device.

According to some other embodiments of the present invention, a lighting device may include a fitting and a light emitting device (LED) electrically coupled to the fitting. A thermally conductive housing may be thermally coupled to the light emitting device. The thermally conductive housing may extend away from the fitting and away from the light emitting device, and the thermally conductive housing may define an outer surface of the lighting device that is substantially free of fins.

A sidewall may extend away from the light emitting device, with portions of the thermally conductive housing being spaced apart from the sidewall to define a cavity between the sidewall and the thermally conductive housing. A base housing may provide mechanical coupling and spacing between the fitting and the light emitting device, and a driver circuit may provide electrical coupling between the fitting and the light emitting device. A lens may be spaced apart from the light emitting device, and the sidewall may extend away from the light emitting device to the lens to define a mixing chamber adjacent the light emitting device. A widest portion of the thermally conductive housing may be in a range of about 90 mm to about 110 mm wide.

The thermally conductive housing may include openings therethrough providing fluid communication between the cavity inside the thermally conductive housing and space outside the thermally conductive housing. In addition, a heat dissipating element may be provided in the cavity between the sidewall and the thermally conductive housing. The heat dissipating element may be thermally coupled with the light emitting device, and portions of the heat dissipating element may be spaced apart from both the sidewall and the thermally conductive housing.

The heat dissipating element may be configured to allow fluid communication between portions of the cavity between the heat dissipating element and the sidewall and portions of the cavity between the heat dissipating element and the thermally conductive housing. Moreover, the thermally conductive housing may be a metal housing, such as an aluminum housing, and the heat dissipating element may be a metal heat dissipating element, such as an aluminum heat dissipating element.

DETAILED DESCRIPTION

Figure 1A:
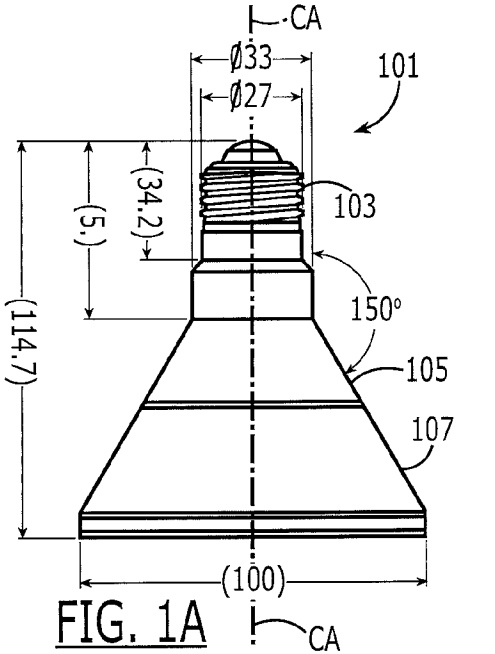
FIGS. 1A, 1B, 1C, and 1D are respective front, right side, left side, and back views of lighting devices according to some embodiments of the present invention.
Figure 1B:
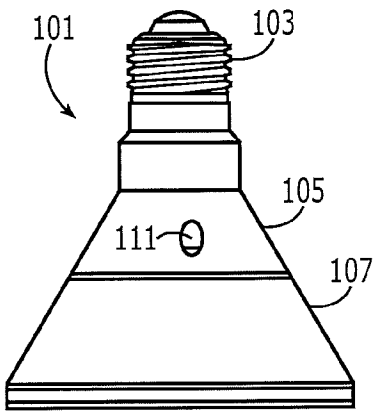
Figure 1C:
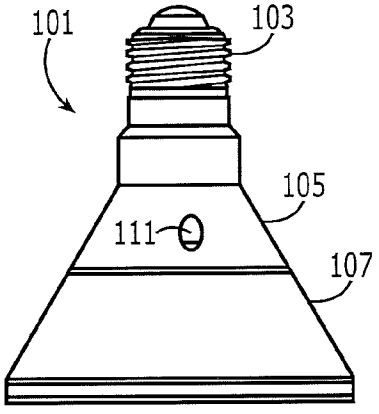
Figure 1D:
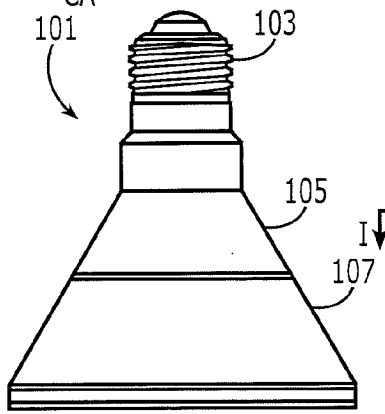

The present invention now will be described more fully with reference to the accompanying drawings, in which various embodiments are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. In contrast, the term "consisting of" when used in this specification, specifies the stated features, steps, operations, elements, and/or components, and precludes additional features, steps, operations, elements and/or components.

It will be understood that when an element such as a layer, region, substrate, or element is referred to as being "on" another element, it can be directly on the other element or intervening elements may also be present. Similarly, when a layer, region, substrate, or element is referred to as being "connected to" or "coupled to" another element, it can be directly connected to or coupled to the other element or intervening elements may be present. Furthermore, relative terms such as "beneath" or "overlies" may be used herein to describe a relationship of one layer or region to another layer or region relative to a substrate or base as illustrated in the figures. It will be understood that these terms are intended to encompass different orientations of the device in addition to the orientation depicted in the figures. Finally, the term "directly" means that there are no intervening elements. As used herein, the term "and/or" includes any and all combinations of one or more of the associated listed items and may be abbreviated as "/".

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Embodiments of the invention are described herein with reference to cross-sectional and/or other illustrations that are schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, a region illustrated or described as a rectangle will, typically, have rounded or curved features due to normal manufacturing tolerances. Thus, the regions illustrated in the figures are schematic in nature and their shapes are not intended to illustrate the precise shape of a region of a device and are not intended to limit the scope of the invention, unless otherwise defined herein. Moreover, all numerical quantities described herein are approximate and should not be deemed to be exact unless so stated.

Unless otherwise defined herein, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

As used herein, a layer or region is considered to be "transparent" when at least 50% of the radiation that impinges on the transparent layer or region emerges through the transparent layer or region. Moreover, the term "phosphor" is used synonymously for any wavelength conversion material(s).

Some embodiments described herein can use light emitting devices such as gallium nitride (GaN)-based solid state light emitting diodes on silicon carbide (SiC)-based mounting substrates. However, it will be understood by those having skill in the art that other embodiments of the present invention may be based on a variety of different combinations of mounting substrate and epitaxial layers. For example, combinations can include AlGaInP solid state light emitting diodes on GaP mounting substrates; InGaAs solid state light emitting diodes on GaAs mounting substrates; AlGaAs solid state light emitting diodes on GaAs mounting substrates; SiC solid state light emitting diodes on SiC or sapphire ($Al_2O_3$) mounting substrates and/or Group III-nitride-based solid state light emitting diodes on gallium nitride, silicon carbide, aluminum nitride, sapphire, zinc oxide and/or other mounting substrates. Moreover, in other embodiments, a mounting substrate may not be present in the finished product. In some embodiments, the solid state light emitting devices may be gallium nitride-based light emitting diode devices manufactured and sold by Cree, Inc. of Durham, N.C., and described generally at cree.com.

Figure 1E:
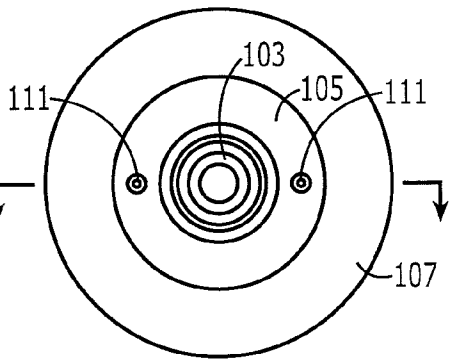
FIGS. 1E and 1F are respective top and bottom views of lighting devices of FIGS. 1A, 1B, 1C, and 1D according to some embodiments of the present invention.
Figure 1F:
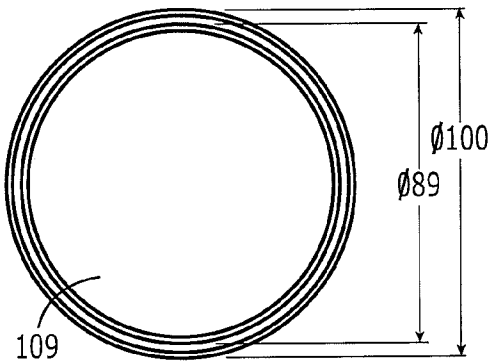
Figure 1G:
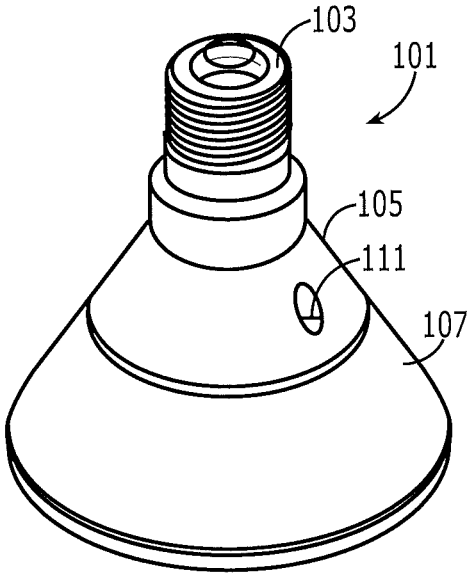
FIGS. 1G and 1H are perspective views of the lighting devices of FIGS. 1A, 1B, 1C, and 1D according to some embodiments of the present invention.
Figure 1H:
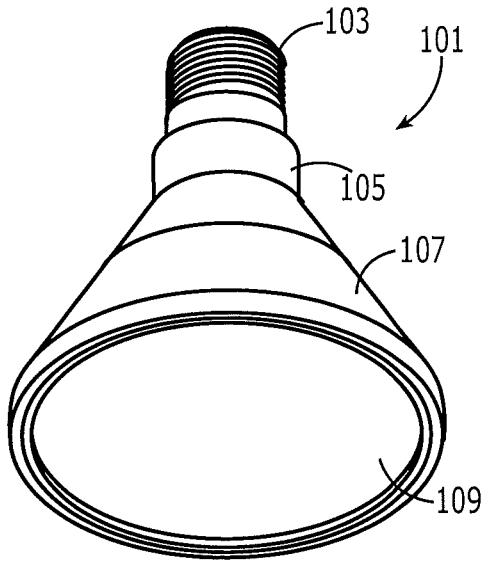
Figure 2A:
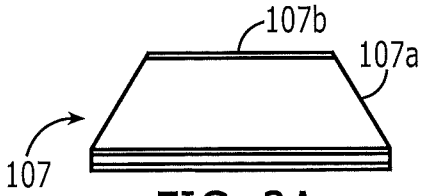
FIGS. 2A and 2B are respective front and top views of a thermally conductive housing of FIGS. 1A-1H according to some embodiments of the present invention.
Figure 2B:
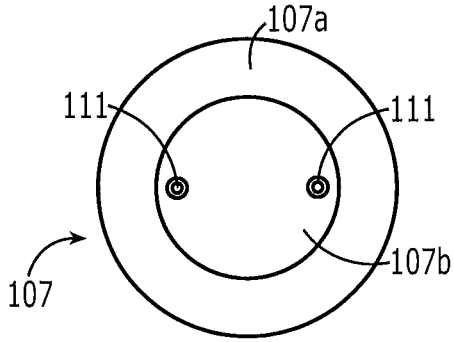
Figure 3:
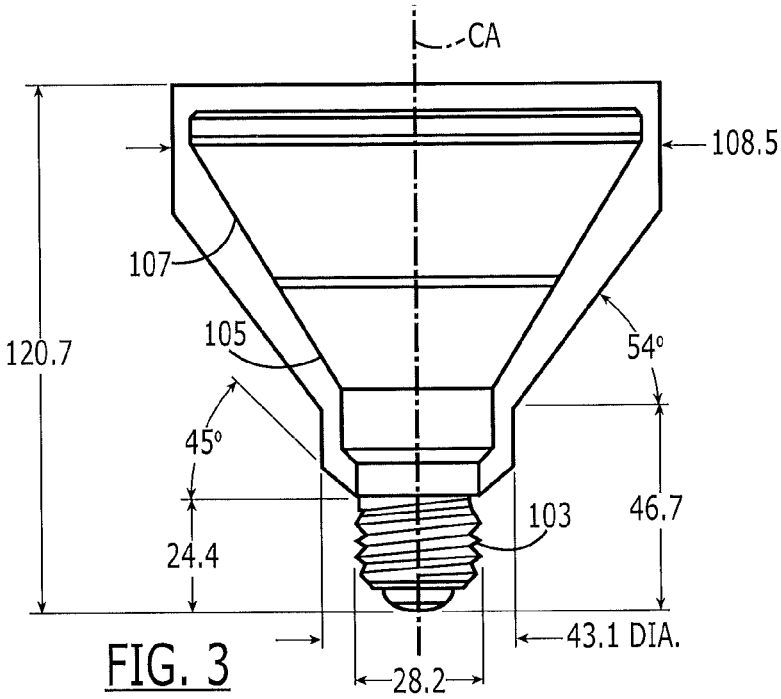
FIG. 3 is a front view of the lighting device of FIGS. 1A, 1B, 1C, and 1D according to some embodiments of the present invention together with maximum dimensions of a conventional lighting device (such as maximum dimensions for PAR30L and/or BR30 light bulbs).
Figure 4:
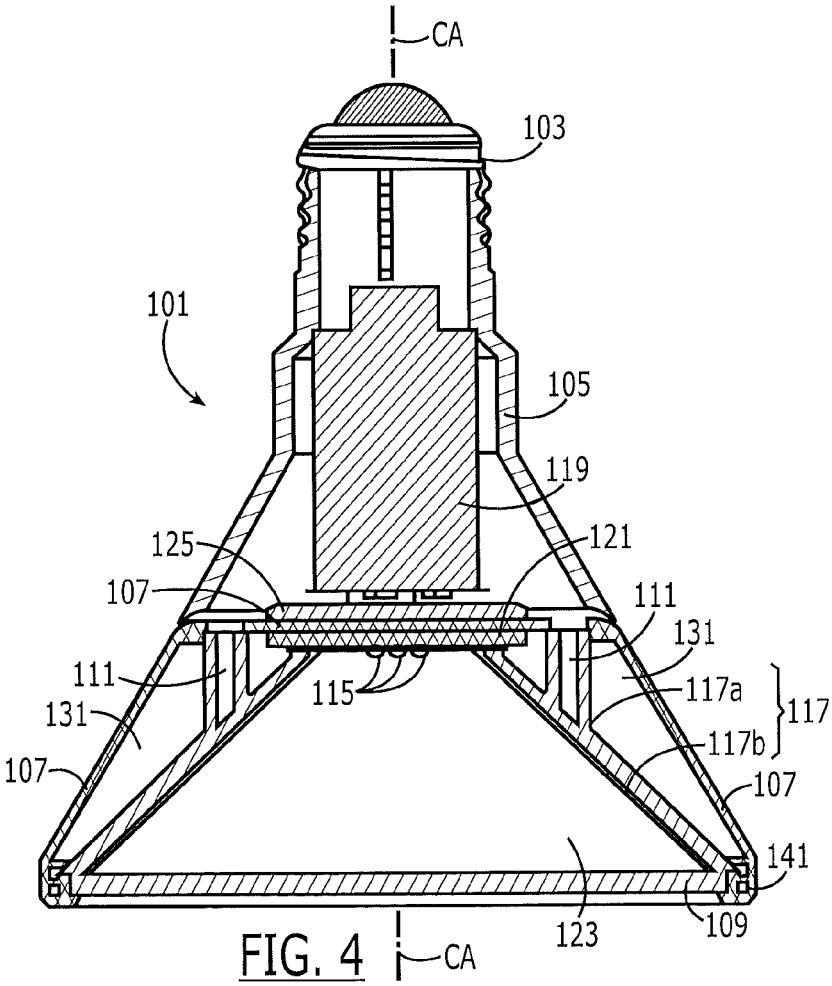
FIG. 4 is a cross sectional view of the lighting device of FIGS. 1A, 1E, and 1F taken along section line I-I' according to some embodiments of the present invention.

FIGS. 1A-1H, 2, 3, and 4 illustrate lighting device 101 and elements thereof according to some embodiments of the present invention. In particular, FIGS. 1A, 1B, 1C, and 1D are respective front, right side, left side, and back views of lighting device 101, and FIGS. 1E and 1F are respective top and bottom views of lighting device 101. FIGS. 1G and 1H are perspective views of lighting device 101, FIGS. 2A and 2B are respective front and top views of thermally conductive housing 107 at the same scale as FIGS. 1A-1H, and FIG. 3 is a front view of lighting device 101 shown with maximum dimensions of conventional lighting devices (such as maximum dimensions for PAR30L and BR30 light bulbs). FIG. 4 is a cross sectional view of lighting device 101 taken along section line I-I' of FIG. 1E. Moreover, dimensions of lighting device 101 are shown in FIGS. 1A, 1F, and 2 in millimeters (mm).

As shown in FIGS. 1A-1H, 2, 3, and 4, lighting device 101 may include Edison screw fitting 103, base housing 105 (e.g., a plastic base housing), thermally conductive housing 107, lens 109, and fastener holes 111. In addition, driver circuit 119 (in base housing 105) may be electrically coupled between light emitting devices 115 and Edison screw fitting 103. As shown in FIG. 4, a plurality of light emitting devices 115 may be provided on substrate 121 (for example, a metal core printed circuit board), and light emitting devices 115 may be provided adjacent/in mixing chamber 123 defined by reflective sidewall 117 and lens 109. For example, reflective sidewall 117 may be provided using plastic sidewall 117*a* with reflective coating 117*b* thereon, or reflective sidewall 117 may be provided using a naturally reflective substance.

Reflective coating 117*b*, for example, may be provided using MCPET (micro-foamed polyethylene terephthalate) as described, for example, in the data sheet entitled "*New Material for Illuminated Panels Microcellular Reflective Sheet MCPET*", by the Furukawa Electric Co., Ltd., updated Apr. 8, 2008, and in a publication entitled "*Furukawa America Debuts MCPET Reflective Sheets to Improve Clarity, Efficiency of Lighting Fixtures*", LED Magazine, 23 May 2007, the disclosures of both of which are hereby incorporated herein by reference in their entirety as if set forth fully herein. In addition or in an alternative, reflective coating 117*b* may be provided using diffuse reflective material (DLR) as described, for example, in a data sheet entitled "*DuPont™ Diffuse Light Reflector*", DuPont publication K-20044, May 2008, and is also described at diffuselightreflector.dupont.com, the disclosures of both of which are hereby incorporated herein by reference in their entirety as if set forth fully herein.

Lighting device 101 may thus be configured to screw into a conventional 120 volt AC light bulb socket, and driver circuit 119 may be configured to convert the 120 volt AC input to a DC output(s) appropriate to drive light emitting devices 115. Light emitting devices 115 may be semiconductor solid state light emitting devices such as light emitting diodes and/or laser diodes that each emits a specific wavelength of light. Accordingly, light emitting devices of different colors and/or phosphors may be used together to generate substantially white light. The use of light emitting diodes of different colors together with phosphors in a same lighting device to generate substantially white light is discussed, for example, in U.S. Pat. No. 7,213,940 to Anthony Paul Van De Ven et al. entitled "Lighting Device And Method", the disclosure of which is hereby incorporated herein in its entirety by reference. Phosphors may be provided, for example, in a coating applied directly on light emitting devices 115, in/on reflective coating 117*b*, and/or in/on lens 109. Light from light emitting devices 115 thus enters mixing chamber 123, reflects off reflective coating 117*b*, and exits through lens 109 to provide illumination. Reflective coating 117*b*, for example, may provide substantially reflection only, reflection and diffusion, reflection and phosphorescence, or reflection and diffusion and phosphorescence. Similarly, lens 109 may provide substantially transmission only, transmission and diffusion, transmission and phosphorescence, or transmission and phosphorescence and diffusion. By providing diffusion at coating 117*b* and/or lens 109, a relatively uniform illumination of white light may be provided so that individual light emitting devices do not appear as discrete sources. Lens 109 may or may not provide a focusing of light.

Performance and/or useful life of light emitting devices 115 may be reduced as a result of elevated temperatures, and light emitting devices 115 may generate significant heat during operation. Accordingly, substrate 121 may be configured to conduct heat from light emitting devices 115 to thermally conductive housing 107, a base 107*b* of which may extend behind substrate 121. Thermally conductive housing 107 may thus include base 107*b* that is thermally coupled to light emitting devices 115 and sidewall 107*a* that is exposed to an outside environment. Accordingly, thermally conductive housing 107 may transfer/radiate/conduct heat generated by the light emitting devices 115 into the environment outside lighting device 101 without requiring fins. An outside surface of sidewall 107*a* of thermally conductive housing 107 may thus be substantially smooth and/or axially symmetric about central axis CA of the device. In addition, heat spreader 125 (e.g., an aluminum plate) may be provided on base 107*b* of thermally conductive housing 107, so that base 107*b* of thermally conductive housing 107 is sandwiched between heat spreader 125 and substrate 121. Heat spreader 125 may thus further reduce a thermal resistance to heat transfer away from light emitting devices 115. In addition, graphite sheet may be provided between substrate 121 and base 107*b* of thermally conductive housing 107 and/or between base 107*b* and heat spreader 125 to reduce thermal contact resistance therebetween.

As further shown in FIG. 4, reflective sidewall 117 may extend away from the light emitting devices 115, and sidewall 107*a* of thermally conductive housing 107 may be spaced apart from reflective sidewall 117 to define cavity 131 between reflective sidewall 117 and sidewall 107*a* of thermally conductive housing 107. Reflective sidewall 117 may thus be provided using relatively inexpensive and light weight molded plastic sidewall 117*a* with reflective coating 117*b* thereon, while thermally conductive housing 107 (including sidewall and base 107*a* and 107*b*) may be provided using a relatively light weight and thermally conductive metal such as aluminum. While not shown in FIG. 1A-H, 2A-B, or 3, sidewall 107*a* of thermally conductive housing 107 may include holes therethrough to provide fluid communication (e.g., ventilation) between cavity 131 and an outside environment thereby further enhancing removal of heat from thermally conductive housing 107. Convection of air through such holes may thus enhance removal of heat from inside surfaces of thermally conductive housing 107 to supplement removal of heat from outside surfaces of thermally conductive housing 107.

By providing sufficient heat transfer/radiation/conduction from substantially smooth sidewall 107*b* of thermally conductive housing 107, lighting device 101 may be configured for use in conventional fixtures such as fixtures adapted for PAL30L and/or BR30 type light bulbs. FIGS. 1A and 1F, for example, show dimensions of lighting device 101 according to some embodiments of the present invention, and FIG. 3 shows an outline of lighting device 101 within a maximum profile allowed for a conventional light bulb. All dimensions are in millimeters (mm), and all dimensions of FIG. 3 are for a largest conventional profile as opposed to dimensions of lighting device 101. A greatest width of thermally conductive housing 107 may be in the range of about 90 mm to about 110 mm, and as shown in FIGS. 1A and 1F, a greatest width of thermally conductive housing may be about 100 mm. Moreover, an outer surface of thermally conductive housing 107 may taper at an angle relative to central axis CA of greater than about 145 degrees, and as shown in FIG. 1A, an outer surface of thermally conductive housing 107 may taper at an angle of about 150 degrees. Moreover, an outer surface of base housing 105 may continue along a same angle of taper as the outer surface of thermally conductive housing 105 to a width (e.g., about 33 mm) about the same as or slightly larger than that of Edison screw fitting 103, and Edison screw fitting 103 may have a width of about 27 mm.

Lighting device 101 of FIGS. 1A-H, 2A-B, 3, and 4 may thus be assembled using relatively inexpensive and light weight plastic for base housing 105 and reflective sidewall 117, while a thermally conductive metal (e.g., aluminum) is used for thermally conductive housing 107. Aligned fastener holes 111 through base housing 105, thermally conductive housing, and reflective sidewall 117 may provide efficient assembly, for example, using screws, snap fittings, etc. A continuous thermally conductive housing 107 (including sidewall 107*a* and base 107*b*) of aluminum may thus provide efficient heat transfer/radiation/conduction without significantly increasing cost and/or weight. Moreover, by providing heat transfer/radiation/conduction through thermally conductive housing 107 without fins, lighting device 101 may be adapted as a replacement for conventional bulbs in conventional fixtures without significantly diminishing performance and/or lifetime of light emitting devices 115.

As shown in FIGS. 1A-H, 2A-B, 3, and 4, a cross section of thermally conductive housing 107 may be substantially symmetric with respect to central axis CA of lighting device 101 with a first width of an outside surface nearest light emitting devices 107 being less than a second width of the outside surface more distant from light emitting devices 107. More particularly, sidewall 107*a* of thermally conductive housing may define a substantially frustoconical shape with a substantially linear slope from wider to narrower portions. According to other embodiments of the present invention, a cross sectional profile of sidewall 107*a* may have a concave slope (like a lower portion of a bell) or a convex slope (like an upper portion of a bell).

Moreover, lens retainer 141 may provide mechanical coupling between lens 109 and thermally conductive housing 107, and lens 109 may be formed of a transparent/translucent material such as glass or plastic. As noted above, lens 109 may provide diffusion and/or phosphorescence in addition to light transmission. Light diffusion may be provided by finely patterning a surface of lens 109 (e.g., with bumps, ridges, etc.), by providing a light diffusing film on a surface of lens 109, by dispersing light diffusing particles throughout a volume of lens 109, etc. Phosphorescence may be provided by providing phosphorescent particles (e.g., phosphors) throughout a volume of lens 109 and/or in a film on a surface of lens 109.

Figure 5:
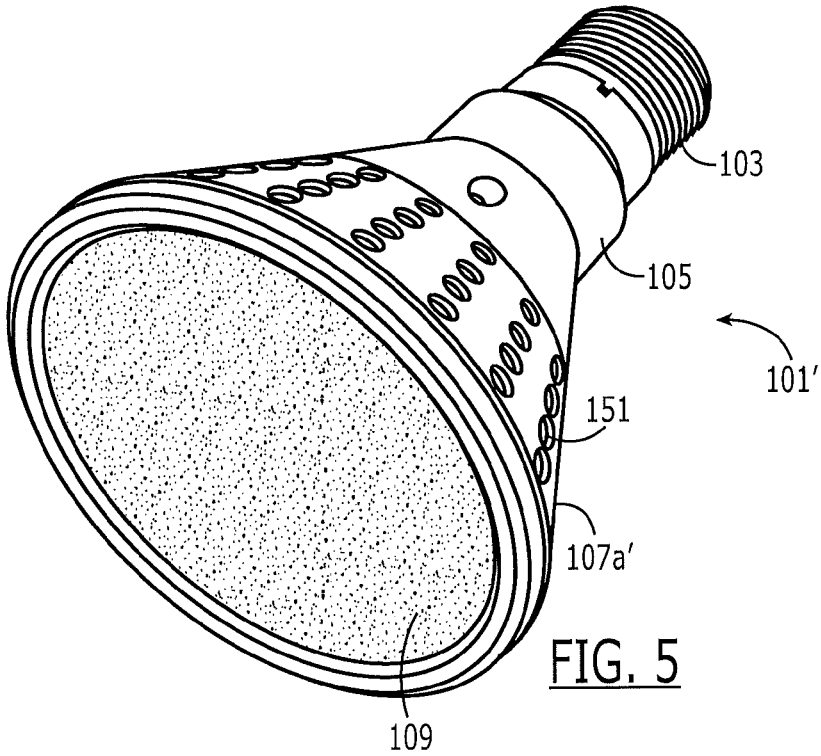
FIG. 5 is a perspective view of lighting devices according to some other embodiments of the present invention.
Figure 6:
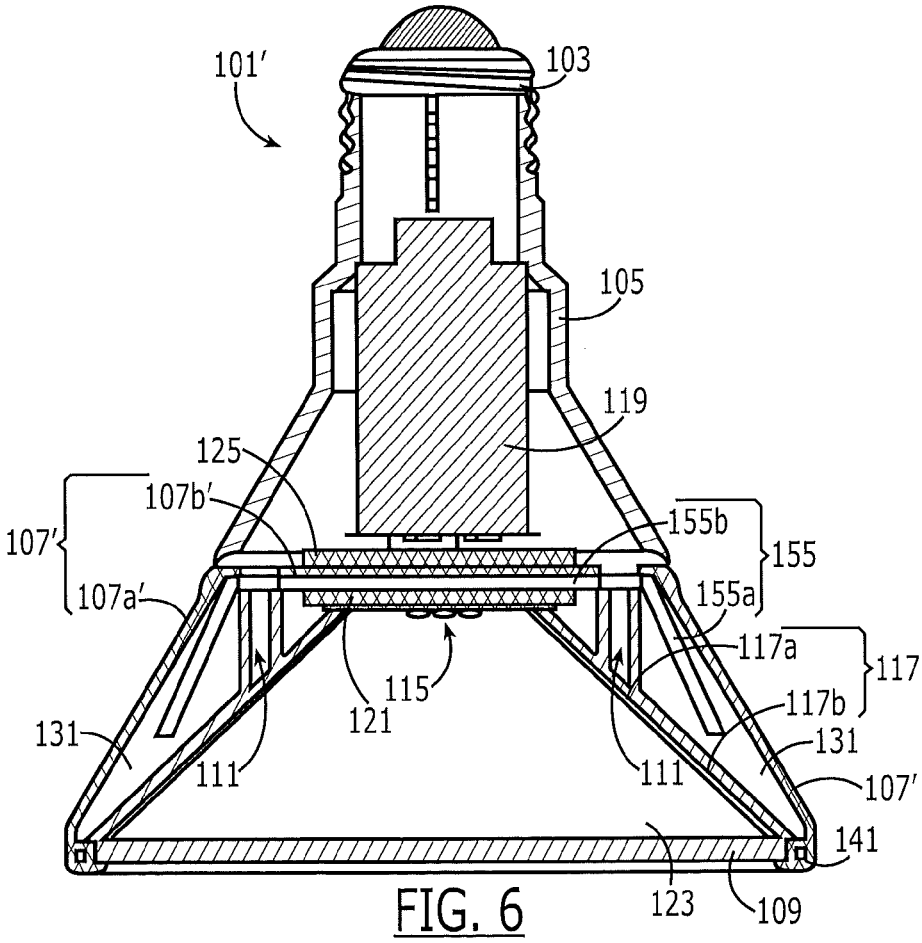
FIG. 6 is a cross sectional view of the lighting device of FIG. 5 according to some embodiments of the present invention.

FIGS. 5 and 6 are perspective and cross sectional views of lighting device 101' according to additional embodiments of the present invention. Lighting device 101' is the same as lighting device 101 with the exceptions that thermally conductive housing 107' includes openings 151 through sidewall 107*a'* thereof, and that an additional heat dissipating element 155 is included in the cavity between reflective sidewall 117 and thermally conductive housing 107'. Otherwise elements of lighting device 101' are the same as those discussed above with respect to lighting device 101, and the same reference numbers are used where the elements are the same. Further discussion of elements that are unchanged relative to lighting device 101 may be omitted for the sake of conciseness.

Openings 151 may thus provide fluid communication (e.g., ventilation) between cavity 131 inside thermally conductive housing 107' and space outside thermally conductive housing 107' to further facilitate cooling. More particularly, by allowing fluid communication (e.g., air flow) through thermally conductive housing 107', cooling of both outside and inside surfaces of sidewall 107*a'* of thermally conductive housing 107' may be facilitated. Fluid communication through thermally conductive housing 107' may also facilitate cooling through heat dissipating element 155 in cavity 131.

As shown in FIG. 6, heat dissipating element 155 may be provided in cavity 131 between reflective sidewall 117 and thermally conductive housing 107'. Moreover, base 155*b* of heat dissipating element 155 may be thermally coupled with light emitting devices 115, and sidewall 155*a* of heat dissipating element 155 may be spaced apart from both reflective sidewall 117 and thermally conductive housing 107'. More particularly, heat dissipating element 155 may be formed of a relatively light thermally conductive metal such as aluminum. Openings 151 through sidewall 107*a'* of thermally conductive housing 107' may thus facilitate dissipation of heat from both thermally conductive housing 107' and heat dissipating element 155. Accordingly, heat dissipating element 155 may effectively increase a surface area from which heat from light emitting devices 115 may be dissipated.

As shown in FIG. 6, heat dissipating element 155 (including sidewall and base 155*a* and 155*b*) may be formed separately from thermally conductive housing 107' and then assembled by aligning fastener holes 111 (of base housing 105, thermally conductive housing 107', heat dissipating element 155, and reflective sidewall 117) and applying fasteners. Heat dissipating element 155 may thus have a shape similar to that illustrated for thermally conductive housing 107 in FIGS. 2A and 2B, with primary differences being that dimensions of heat dissipating element 155 are scaled down sufficiently to allow heat dissipating element 155 to fit in cavity 131 as shown in FIG. 6. In other words, portions of base 155*b* (including fastener holes 111 therethrough) may be provided between substrate 121 (e.g., metal core printed circuit board) and base 107*b'* of thermally conductive housing 107', and sidewall 155*a* of heat dissipating element 155 may extend into cavity 131 which is ventilated via openings 151 through sidewall 107*a'* of thermally conductive housing 107'.

According to other embodiments of the present invention, thermally conductive housing 107' and heat dissipating element 155 may be provided as a single metal (e.g., aluminum) piece sharing a single base. More particularly, base 107*b'* of thermally conductive housing 107' may be provided between substrate 121 and aluminum plate 125, and sidewall 155*a* of heat dissipating element 155 may extend directly from an interior of base 107*b'* of thermally conductive housing 107'.

Thermal resistances between light emitting devices 115 and sidewall 107*a*' of thermally conductive housing 107' may thus be reduced by reducing thermal interfaces between separate bases 155*b* and 107*b*'.

Figure 7B:
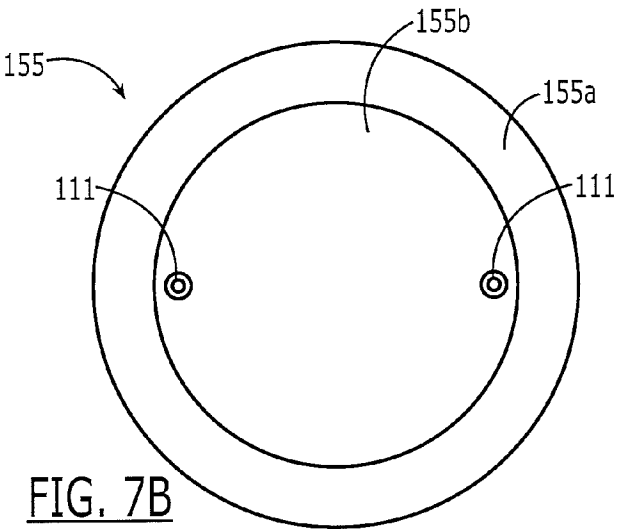
FIGS. 7A and 7B are respective front and top views of a heat dissipating element of FIG. 6 according to some other embodiments of the present invention.
Figure 7A:
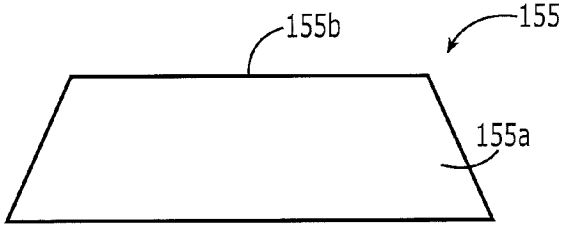

Cross sections of thermally conductive housing 107 and heat dissipating element 155 may be substantially symmetric with respect to central axis CA of lighting device 101' with widths of outside surfaces thereof nearest light emitting devices 115 being less than widths of the outside surfaces more distant from light emitting devices 115. More particularly, sidewall 155*a* of heat dissipating element 155 and sidewall 107*a*' of thermally conductive housing 107' may both have substantially frustoconical shapes, and sidewall 155*a* of heat dissipating element 155 may have a more vertical slope than sidewall 107*a*' of thermally conductive housing. FIGS. 7A and 7B are respective front and top views of heat dissipating element 155 having a substantially frustoconical shape according to some embodiments of the present invention. According to other embodiments of the present invention, a cross sectional profile of sidewall 107*a*' of thermally conductive housing 107' and/or sidewall 155*a* of heat dissipating element 155 may have a concave slope (like a lower portion of a bell) or a convex slope (like an upper portion of a bell).

Figure 8B:
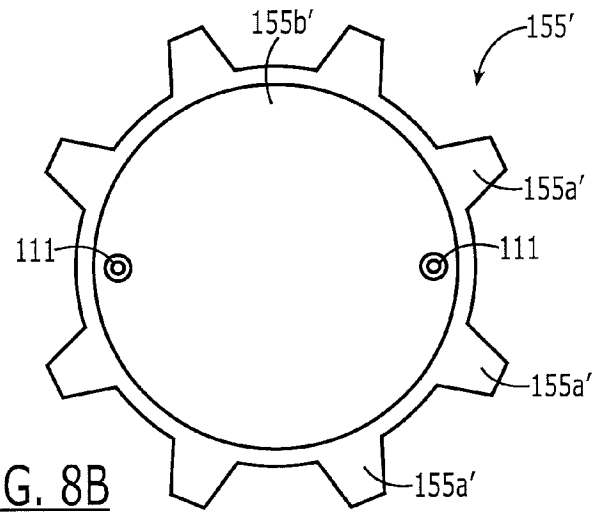
FIGS. 8A and 8B are respective front and top views of heat dissipating element of FIG. 6 according to some other embodiments of the present invention.
Figure 8A:
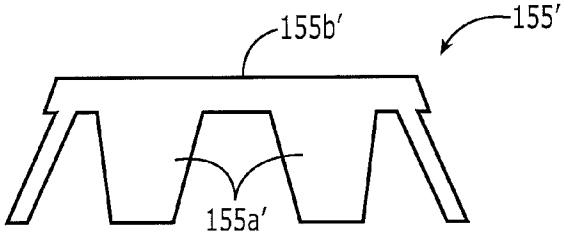

As shown in FIG. 6, a length of sidewall 155*a* of heat dissipating element 155 may be less than a length of sidewall 107*a*' of thermally conductive housing 107 to allow fluid communication (e.g., ventilation) between portions of cavity 131 between heat dissipating element 155 and reflective sidewall 117 and portions of cavity 131 between heat dissipating element 155 and thermally conductive housing 107'. According to other embodiments of the present invention, fluid communication between portions of cavity 131 between heat dissipating element 155 and reflective sidewall 117 and portions of cavity 131 between heat dissipating element 155 and thermally conductive housing 107' may be provided using openings through and/or gaps in sidewall 155*a* of heat dissipating element. According to still other embodiments of the present invention, sidewall 155*a* of heat dissipating element 155 may be provided as spaced apart leaves with gaps therebetween to allow fluid communication below, around, and/or between leaves. FIGS. 8A and 8B are respective front and top views of heat dissipating element 155' according to some other embodiments of the present invention. Base 155*b*' may be unchanged relative to base 155*b* of FIGS. 7A and 7B, but sidewall 155*a*' may include a plurality of spaced apart leaves instead of providing a continuous frustoconical shape.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

Figure 9:
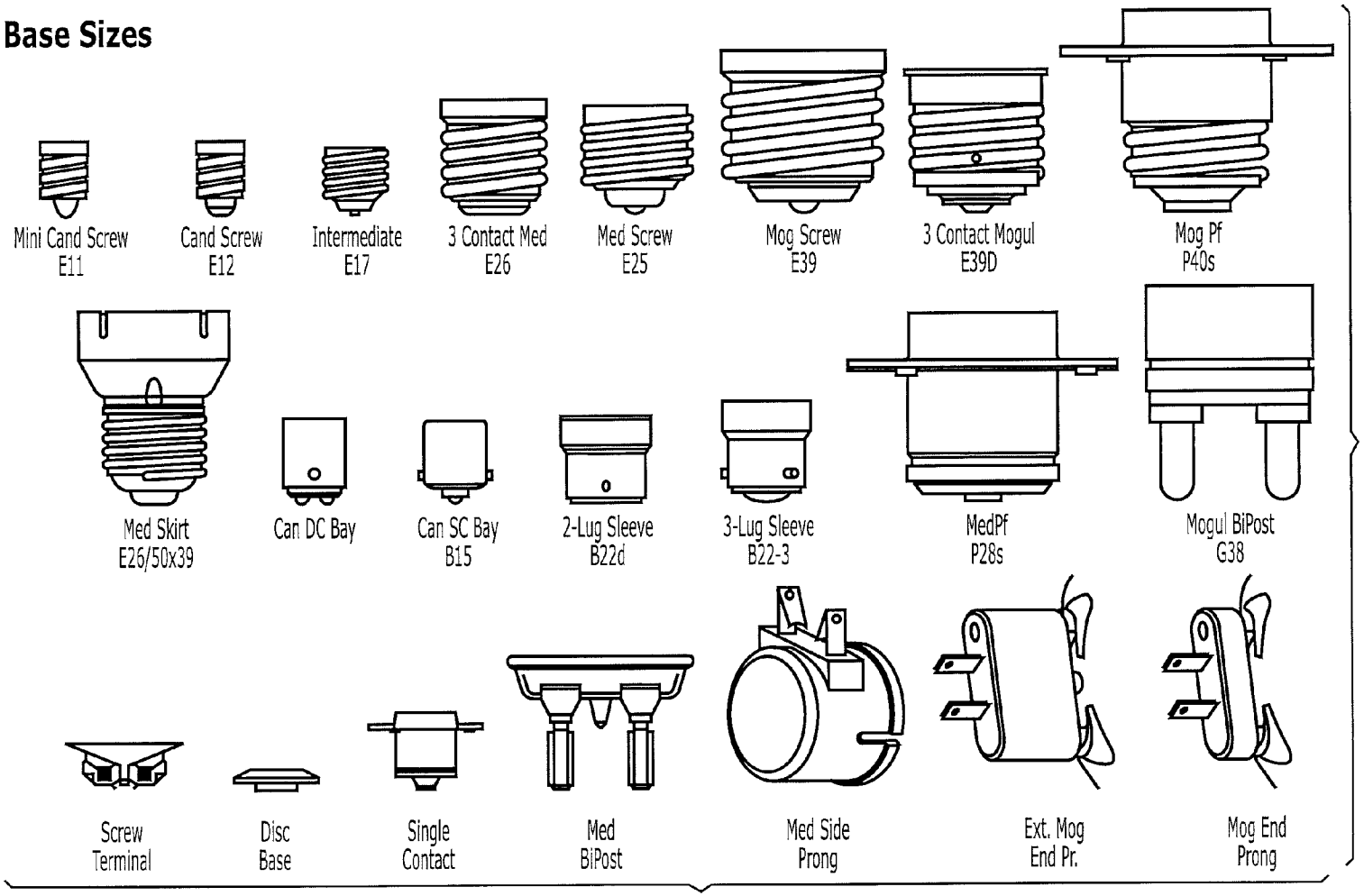
FIG. 9 illustrates examples of electrical fitting shapes/dimensions that may be used with lighting devices according to embodiments of the present invention.
Figure 10A:
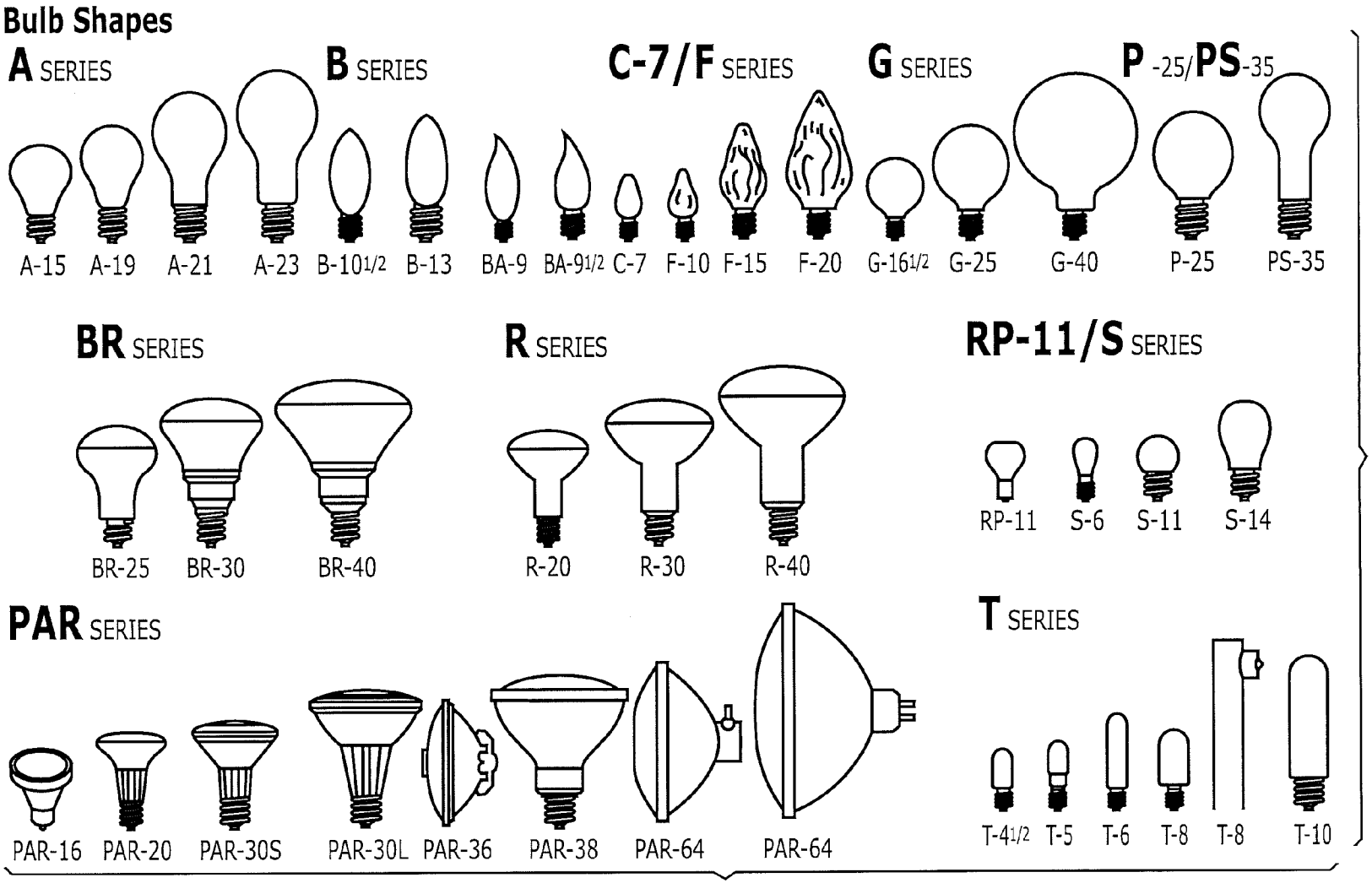
FIGS. 10A and 10B illustrate examples of bulb shapes/dimensions with which lighting devices may be compatible (e.g., fit within) according to embodiments of the present invention.
Figure 10B:
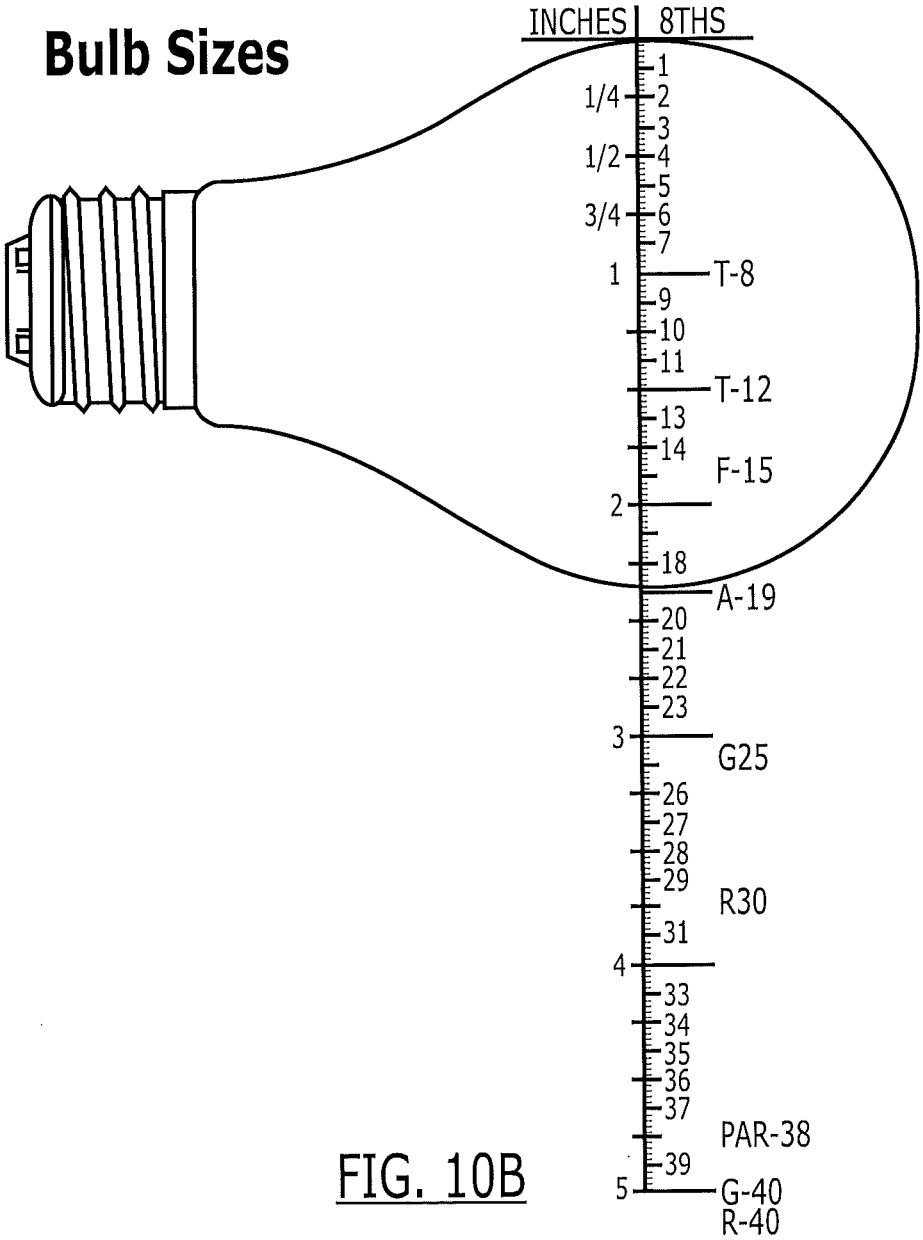

In the drawings and specification, there have been disclosed embodiments of the invention and, although specific terms are employed, they are used in a generic and descriptive sense only and not for purposes of limitation, the scope of the invention being set forth in the following claims. Edison screw fittings are discussed by way of example, but lighting devices according to embodiments of the present invention may be used with other electrical fittings (also referred to as bases), such as, screw fittings (e.g., E11, E12, E17, E26, E39, E39D, P40s, E26/59×39, etc.), can fittings (e.g., Can DC Bay, Can SC Bay B15, etc.), sleeve fittings (e.g., B22d, B22-3, P28s, etc.), post fittings (e.g., Mogul BiPost G38, Med BiPost, etc.), contact fittings (e.g., screw terminal, disc base, single contact, etc.), side prong fittings, end prong fittings (e.g., Ext. Mog End Prong, Mog End Prong, etc.), etc. FIG. 9 illustrates examples of electrical fitting shapes/dimensions that may be used with lighting devices according to embodiments of the present invention. Similarly, lighting devices having dimensions compatible with PAR30 and BAR30 bulb shapes are discussed by way of example, but lighting devices according to embodiments of the present invention may have dimensions compatible with other bulb shapes/dimensions, such as, A series bulb shapes (e.g., A-15, A-19, A-21, A-23, etc.), B series bulb shapes (e.g., B-10½, B-13, BA-9, BA-9½, etc.), C-7/F series bulb shapes (e.g., F-10, F-15, F-20, etc.), G series bulb shapes (e.g., G-16½, G-25, G-40, etc.), P-25/PS-35 bulb shapes (e.g., P-25, PS-35, etc.), BR series bulb shapes (e.g., BR-25, BR-30, BR-40, etc.), R series bulb shapes (e.g., R-20, R-30, R-40, etc.), RP-11/S series bulb shapes (e.g., RP-11, S-6, S-11, S-14, etc.), PAR series bulb shapes (e.g., PAR-16, PAR-20, PAR-30S, PAR-30L, PAR-38, PAR-64, etc.), and/or T series bulb shapes (e.g., T-4½, T-5, T-6, T-8, T-10, etc.). FIGS. 10A and 10B illustrate examples of bulb shapes/dimensions with which lighting devices according to embodiments of the present invention may be compatible. Electrical fittings, bulb shapes, and bulb dimensions are discussed, for example, in Bulborama, "Lighting Reference, Common Light Bulb Terms, Bulb Shapes, Glossary," http://www.bulborama.com/reference.html, the disclosure of which is hereby incorporated herein in its entirety by reference.

That which is claimed is:

1. A lighting device comprising:

a light emitting device;

a reflective sidewall extending away from the light emitting device;

a thermally conductive housing spaced apart from the reflective sidewall, wherein a cavity is defined between the reflective sidewall and the thermally conductive housing;

a heat dissipating element that extends into the cavity between the reflective sidewall and the thermally conductive housing, wherein portions of the heat dissipating element are spaced apart from both the reflective sidewall and the thermally conductive housing; and a substrate adjacent the reflective sidewall, wherein the light emitting device is on a surface of the substrate adjacent the reflective sidewall, wherein the heat dissipating element extends into the cavity away from the substrate, and wherein a width of the heat dissipating element increases with increasing distance from the substrate.

2. A lighting device according to claim 1 wherein the thermally conductive housing includes openings therethrough providing fluid communication between the cavity inside the thermally conductive housing and space outside the thermally conductive housing.

3. A lighting device according to claim 2 further comprising:

a heat dissipating element that extends into the cavity between the reflective sidewall and the thermally conductive housing, wherein portions of the heat dissipating element are spaced apart from both the reflective sidewall and the thermally conductive housing.

4. A lighting device according to claim 3 wherein the heat dissipating element is configured to allow fluid communication between portions of the cavity between the heat dissipating element and the reflective sidewall and portions of the cavity between the heat dissipating element and the thermally conductive housing.

5. A lighting device according to claim 3 wherein the thermally conductive housing and the heat dissipating element are both thermally coupled to the light emitting device.

6. A lighting device according to claim 1 further comprising:

a planar lens spaced apart from the light emitting device, wherein the reflective sidewall extends away from the light emitting device to the lens to define a mixing chamber adjacent the light emitting device.

7. A lighting device according to claim 6 wherein the thermally conductive housing is outside the mixing chamber defined by the reflective sidewall and the lens.

8. A lighting device according to claim 1 wherein a cross section of the outside surface of the thermally conductive housing is substantially symmetric with respect to a central axis of the lighting device, wherein a first width nearest the light emitting device is less than a second width more distant from the light emitting device.

9. A lighting device according to claim 8 wherein the outside surface of the thermally conductive housing defines a substantially frustoconical shape.

10. A lighting device according to claim 8 wherein the outside surface of the thermally conductive housing is free of fins.

11. A lighting device according to claim 10 wherein a greatest width of the outside surface of the thermally conductive housing is in the range of about 90 mm to about 110 mm.

12. A lighting device according to claim 11 further comprising:

an Edison screw fitting electrically coupled to the light emitting device, wherein the Edison screw fitting aligned with the central axis of the lighting device.

13. A lighting device according to claim 1 wherein the reflective sidewall comprises an inner surface adjacent the light emitting device and an outer surface, wherein the inner surface is between the outer surface and the light emitting device, and wherein the inner surface is reflective.

14. A lighting device comprising:

a fitting;

a substrate defining a plane;

a light emitting device (LED) on a surface of the substrate, wherein the light emitting device is electrically coupled to the fitting; and a thermally conductive housing thermally coupled to the light emitting device, wherein the thermally conductive housing extends away from the fitting, away from the plane of the substrate, and away from the light emitting device, and wherein the thermally conductive housing defines an outer surface of the lighting device that is substantially free of fins; and a reflective sidewall extending away from the light emitting device, away from the plane of the substrate, and away from the fitting, wherein portions of the thermally conductive housing are spaced apart from the reflective sidewall to define a cavity between the reflective sidewall and the thermally conductive housing;

wherein the thermally conductive housing includes at least one opening therethrough providing fluid communication between the cavity inside the thermally conductive housing and a space outside the thermally conductive housing, wherein the opening and the fitting are on opposite sides of the plane of the substrate, and wherein a distance of a portion of the reflective sidewall from the plane of the substrate in a direction that is perpendicular to the plane of the substrate is greater than a distance of the at least one opening from the plane of the substrate in the direction that is perpendicular to the plane of the substrate.

15. A lighting device according to claim 14 further comprising:

a base housing providing mechanical coupling and spacing between the fitting and the light emitting device; and a driver circuit providing electrical coupling between the fitting and the light emitting device.

16. A lighting device according to claim 14 further comprising:

a lens spaced apart from the light emitting device, wherein the reflective sidewall extends away from the light emitting device to the lens to define a mixing chamber adjacent the light emitting device.

17. A lighting device according to claim 14 wherein a widest portion of the thermally conductive housing is in the range of about 90 mm to about 110 mm wide.

18. A lighting device according to claim 14 further comprising:

a heat dissipating element that extends into the cavity between the reflective sidewall and the thermally conductive housing, wherein the heat dissipating element is thermally coupled with the light emitting device, and wherein portions of the heat dissipating element are spaced apart from both the reflective sidewall and the thermally conductive housing.

19. A lighting device according to claim 18 wherein the heat dissipating element is configured to allow fluid communication between portions of the cavity between the heat dissipating element and the reflective sidewall and portions of the cavity between the heat dissipating element and the thermally conductive housing.

20. A lighting device according to claim 14 wherein the fitting comprises an Edison screw fitting.

21. A lighting device according to claim 6 wherein the reflective sidewall is between portions of the lens and the heat dissipating element.

22. A lighting device according to claim 16 wherein the reflective sidewall is between portions of the lens and the heat dissipating element.

23. A lighting device according to claim 1 wherein the heat dissipating element comprises spaced apart leaves in the cavity.

24. A lighting device according to claim 14 wherein the heat dissipating element comprises spaced apart leaves in the cavity.

25. A lighting device according to claim 1 wherein the thermally conductive housing includes a thermally conductive housing base, the device further comprising:

an electrical fitting electrically coupled to the light emitting device; and a substrate adjacent the reflective sidewall, wherein the light emitting device is on a surface of the substrate adjacent the reflective sidewall, wherein portions of the thermally conductive housing base are between the substrate and the electrical fitting.

26. A lighting device comprising:

a light emitting device;

a reflective sidewall extending away from the light emitting device; and a thermally conductive housing spaced apart from the reflective sidewall, wherein a cavity is defined between the reflective sidewall and the thermally conductive housing wherein the thermally conductive housing includes a thermally conductive housing base;

a heat dissipating element that extends into the cavity between the reflective sidewall and the thermally conductive housing, wherein portions of the heat dissipating element are spaced apart from both the reflective sidewall and the thermally conductive housing;

an electrical fitting electrically coupled to the light emitting device; and a substrate adjacent the reflective sidewall, wherein the light emitting device is on a surface of the substrate adjacent the reflective sidewall, wherein portions of the thermally conductive housing base are between the substrate and the electrical fitting;

wherein the heat dissipating element and the thermally conductive housing including the thermally conductive housing base are provided as a single metal piece.

27. A lighting device comprising:

a light emitting device;

a reflective sidewall extending away from the light emitting device;

a thermally conductive housing spaced apart from the reflective sidewall, wherein a cavity is defined between the reflective sidewall and the thermally conductive housing wherein the thermally conductive housing includes a thermally conductive housing base;

a heat dissipating element that extends into the cavity between the reflective sidewall and the thermally conductive housing, wherein portions of the heat dissipating element are spaced apart from both the reflective sidewall and the thermally conductive housing;

an electrical fitting electrically coupled to the light emitting device; and a substrate adjacent the reflective sidewall, wherein the light emitting device is on a surface of the substrate adjacent the reflective sidewall, wherein portions of the thermally conductive housing base are between the substrate and the electrical fitting;

wherein the thermally conductive housing and the thermally conductive housing base are provided as a first continuous metal piece, wherein the heat dissipating element includes a heat dissipating base that extends between the substrate and the thermally conductive housing base, and wherein the heat dissipating element and the heat dissipating base are provided as a second continuous metal piece.

28. A lighting device comprising:

a fitting;

a light emitting device (LED) electrically coupled to the fitting; and a thermally conductive housing thermally coupled to the light emitting device, wherein the thermally conductive housing extends away from the fitting and away from the light emitting device, wherein the thermally conductive housing defines an outer surface of the lighting device that is substantially free of fins, and wherein the thermally conductive housing includes a thermally conductive housing base;

a reflective sidewall extending away from the light emitting device, wherein portions of the thermally conductive housing are spaced apart from the reflective sidewall to define a cavity between the reflective sidewall and the thermally conductive housing, and wherein the thermally conductive housing includes openings therethrough providing fluid communication between the cavity inside the thermally conductive housing and space outside the thermally conductive housing;

a heat dissipating element that extends into the cavity between the reflective sidewall and the thermally conductive housing, wherein the heat dissipating element is thermally coupled with the light emitting device, and wherein portions of the heat dissipating element are spaced apart from both the reflective sidewall and the thermally conductive housing; and a substrate adjacent the reflective sidewall, wherein the light emitting device is on a surface of the substrate adjacent the reflective sidewall, wherein portions of the thermally conductive housing base are between the substrate and the electrical fitting.

29. A lighting device according to claim 28 wherein the heat dissipating element and the thermally conductive housing including the thermally conductive housing base are provided as a single metal piece.

30. A lighting device according to claim 28 wherein the thermally conductive housing and the thermally conductive housing base are provided as a first continuous metal piece, wherein the heat dissipating element includes a heat dissipating base that extends between the substrate and the thermally conductive housing base, and wherein the heat dissipating element and the heat dissipating base are provided as a second continuous metal piece.

31. A lighting device according to claim 18 wherein the heat dissipating element extends into the cavity away from the fitting, and wherein a width of the heat dissipating element increases with increasing distance from the fitting.

32. A lighting device comprising:

a substrate defining a plane;

a light emitting device on a surface of the substrate, wherein the light emitting device is on a light emitting device side of the plane of the substrate;

a reflective sidewall adjacent the light emitting device, wherein the reflective sidewall extends away from the light emitting device and away from the plane of the substrate on the light emitting device side of the plane;

a thermally conductive housing spaced apart from the reflective sidewall, wherein a cavity is defined between the reflective sidewall and the thermally conductive housing; and a heat dissipating element that extends into the cavity between the reflective sidewall and the thermally conductive housing on the light emitting device side of the plane, wherein portions of the heat dissipating element in the cavity are spaced apart from both the reflective sidewall and the thermally conductive housing.

33. A lighting device according to claim 32 wherein a width of the heat dissipating element increases with increasing distance from the substrate.

34. A lighting device according to claim 32 further comprising:

a planar lens spaced apart from the light emitting device, wherein the reflective sidewall extends away from the light emitting device to the lens to define a mixing chamber adjacent the light emitting device.

35. A lighting device according to claim 32 wherein the thermally conductive housing includes an opening therethrough, wherein the opening is on the light emitting device side of the plane, and wherein at least a portion of heat dissipating element is between at least one of the openings and the reflective sidewall on the light emitting device side of the plane.

36. A lighting device comprising:

a light emitting device;

a reflective sidewall extending away from the light emitting device; and a thermally conductive housing spaced apart from the reflective sidewall, wherein a cavity is defined between the reflective sidewall and the thermally conductive housing; and a planar lens spaced apart from the light emitting device, wherein the reflective sidewall extends away from the light emitting device to the lens to define a mixing chamber adjacent the light emitting device.

37. A light emitting device according to claim 36 further comprising:

a substrate defining a plane wherein the light emitting device is on a light emitting device side of the plane of the substrate; and a heat dissipating element that extends into the cavity between the reflective sidewall and the thermally conductive housing on the light emitting device side of the plane, wherein portions of the heat dissipating element in the cavity are spaced apart from both the reflective sidewall and the thermally conductive housing.

38. A lighting device according to claim 37 wherein a width of the heat dissipating element increases with increasing distance from the substrate.

39. A lighting device according to claim 38 wherein the thermally conductive housing includes at least one opening therethrough providing fluid communication between the cavity inside the thermally conductive housing and a space outside the thermally conductive housing, wherein the opening is on the light emitting device side of the plane, and wherein a distance of a portion of the reflective sidewall from the plane of the substrate in a direction that is perpendicular to the plane of the substrate is greater than a distance of the at least one opening from the plane of the substrate in the direction that is perpendicular to the plane of the substrate.

* * * * *